US006089424A

United States Patent [19]

Colquhoun

[11] Patent Number: 6,089,424

[45] Date of Patent: Jul. 18, 2000

[54] FASHION DOLL CLOTHING AND ACCESSORY DISPLAY MANNEQUIN

[75] Inventor: Mary Ellen Colquhoun, West Palm Beach, Fla.

[73] Assignee: Michelle L. Johnson, Dixon, Mo.

[21] Appl. No.: 09/190,584

[22] Filed: Nov. 12, 1998

Related U.S. Application Data

[60] Provisional application No. 60/065,807, Nov. 14, 1997.

[51] Int. Cl.[7] ..... A41H 5/00

[52] U.S. Cl. ..... 223/120; 223/66

[58] Field of Search ..... 223/66, 68, 74, 223/77, 120; 434/396

[56] References Cited

U.S. PATENT DOCUMENTS

| | | | |
|---|---|---|---|
| 3,009,284 | 11/1961 | Ryan | 223/66 |
| 3,168,227 | 2/1965 | Osmond | 223/66 |
| 3,779,433 | 12/1973 | Imai | 223/66 |
| 3,865,284 | 2/1975 | Kazama et al. | 223/68 |
| 5,002,211 | 3/1991 | Caldwell et al. | 223/107 |
| 5,409,150 | 4/1995 | Tanquilli | 223/68 |

*Primary Examiner*—Bibhu Mohanty

[57] ABSTRACT

A dress form shaped mannequin for the holding, containing and display of doll fashion ensembles. A mannequin comprising a human shaped Torso (#1) for the display of garments from a fashion ensemble. Bottom of Torso (#1) is permanently connected to Uppere End of Stem (#7) and supported upright by a vertical Stem (#2) that fits into and is removable from a Tray Base (#3). The Stem (#2) is held upright by the Lower End of Stem (#8) being placed in the Stem Holder of Tray Base (#6). A mannequin comprising a Tray Base (#3) to hold, contain and display the accessories from an ensemble of doll fashions. A Rim on Tray Base (#4) that is attached to the outer edge of the Tray Base (#3) and that contains and keeps in place, accessories from an ensemble that are placed on a Horizontal Plate of Tray Base (#5).

2 Claims, 3 Drawing Sheets

FASHION DOLL CLOTHING AND ACCESSORY DISPLAY MANNEQUIN

This application claims benefit of Provisional application 60/065,807 filed Nov. 14, 1997.

BACKGROUND

1. Field of Invention

This invention relates to dress forms and mannequins that display clothing.

2. Description of Prior Art

Prior to the invention described herein, collectors of doll clothing did not have a product to hold, contain and display an ensemble as it was originally produced, packaged and sold, including accessories such as, shoes, handbags, gloves, jewelry and hats. Dress forms previously available only displayed the articles of clothing and had no portion or part of the form useable or suitable for holding, containing and displaying the accessories to the ensemble. Although the accessories to an ensemble or outfit are coordinated by material, shape, style and color, and are especially designed to go with and accompany the clothing of an ensemble, no means has previously been available to display these accessories along with the items of clothing. Therefore, the accessories have ended-up stored, usually in plastic bags or left sitting loose near the the clothing display and subject to being lost or misplaced. Since many of these ensembles are costly, ranging from $25 to over $2,000 each, this product fills the need both functionally and economically of doll fashion collectors.

No dress form shaped display mannequin has been found that can hold, contain and display the ensemble accessories along with the ensemble clothing.

Most dress forms such as U.S. Pat. No. 3,865,284 have a purpose of adjusting to duplicate a size of human form and relate to making clothes rather than displaying clothing.

Garment Display Device, U.S. Pat. No. 4,792,071 comprises a variable configuration clothes hanger with shelf for accessories.

Other clothing mannequins such as U.S. Pat. Nos. 5,310,099; 5,480,074; 5,022,569; and 5,409,150 do not include a way to hold, contain nor display accessories to an ensemble.

With the advent and growth of doll fashion collecting, especially vintage ensembles, came the need to keep and display them together as they were originally produced, packaged and sold. This is reinforced by the fact that the small accessories are usually the most valuable part of the ensemble and the most rare.

OBJECTS AND ADVANTAGES

Accordingly, the object of my invention is to provide a dress form shaped mannequin that has an incorporated means of holding and self-containing an entire ensemble of doll fashions as they were originally produced, packaged and sold. Accessories include but are not limited to shoes, handbags, gloves, jewelry and hats. An advantage of my invention is that accessories of an ensemble are not as likely to become separated from the clothing of an ensemble and as likely to be lost of misplaced.

DRAWING FIGURES

Figure 1:
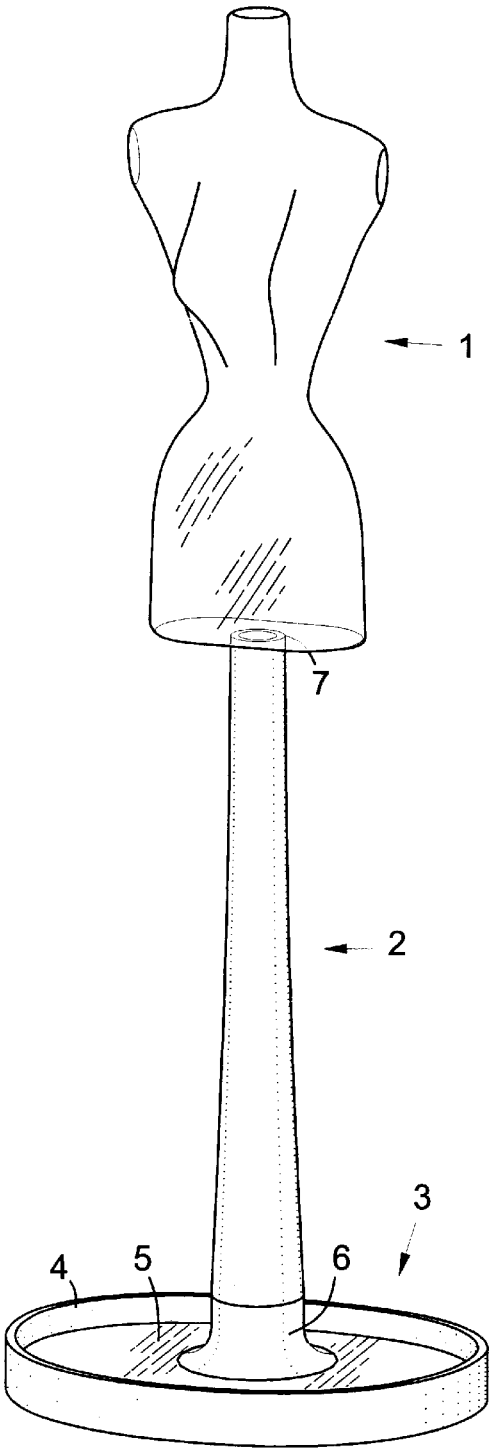
FIG. 1 Shows a Perspective Front View of the Mannequin

| Reference Numerals in Drawings | | | |
|---|---|---|---|
| 1 | Torso | 3 | Tray Base |
| 1A | Front Part of Torso | 4 | Rim on Tray Base |
| 1B | Back Part of Torso | 5 | Horizontal Plate of Tray Base |
| 2 | Stem | 6 | Stem Holder of Tray Base |
| 2A | Front Part of Stem | 7 | Upper End of Stem |
| 2B | Back Part of Stem | 8 | Lower End of Stem |

DESCRIPTION

A typical embodiment of this invention is illustrated in FIG. 1. FIG. 1 shows a Perspective Front View of the Mannequin. There are 3 main parts of the Mannequin: #1 Torso, #2 STem and #3 Tray Base. #1 Torso is permanently connected to the #2 Stem. #2 Stem connects the #1 Torso to the #3 Tray Base. #1 Torso has a slightly elongated neck, otherwise a normal human shape ending at the bottom hip line. The formed shape is hollow of a thin wall. #2 Stem is Cylindrical and tapers from bottom to top. #2 Stem is also hollow and formed of a thin wall. #2 Stem is permanently connected to the bottom of the #1 Torso at the #7 Upper End of the Stem and removable from the #6 Stem Holder that is a part of the #3 Tray Base. #3 Tray Base is comprised of a #4 Rim on Tray Base that is raised or elevated from and attached to the outer edge of #5 Horizontal Plate of Tray Base. #5 Horizontal Plate of Tray Base is the flat bottom surface of #3 Tray Base. #6 Stem Holder is a part of #3 Tray Base. #6 Stem Holder is cylindrical and open on both top and bottom ends. #3 Tray Base is solid not hollow.

Figure 2:
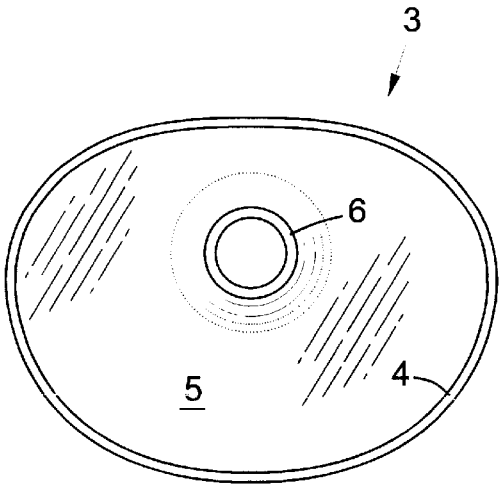
FIG. 2 Shows a Top View of the Tray Base

FIG. 2 shows a top view of #3 Tray Base, #4 Rim on Tray Base, #5 Horizontal Plate of Tray Base and #6 Stem Holder of TRay Base. #6 Stem HOlder os TRay Base is shown open at top as well as at bottom.

Figure 3:
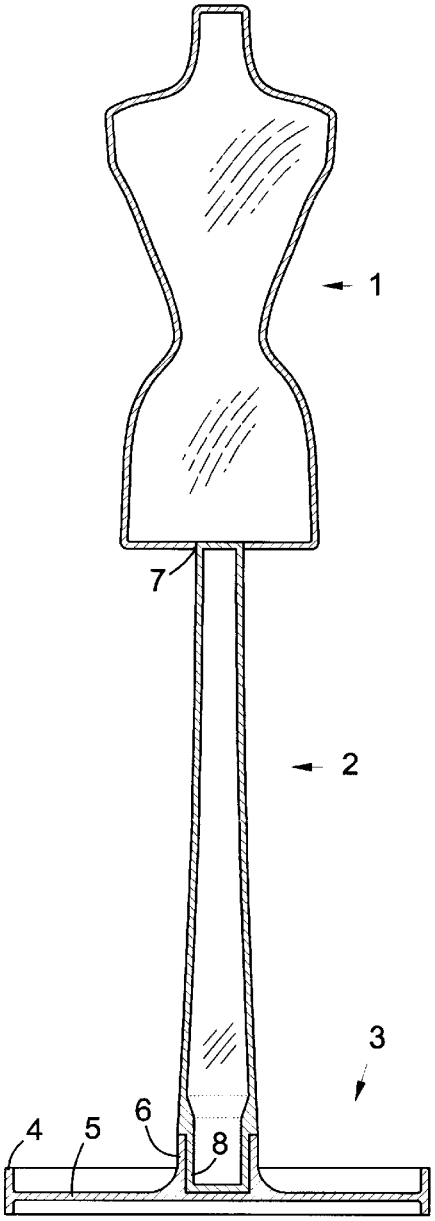
FIG. 3 Shows a Front Sectional View of the Mannequin

FIG. 3 shows a Front Sectional View of the hollow mannequin with addition of #8 Lower End of the Stem which is removable from Tray Base. #8 Lower End of Stem is undercut and slightly smaller than opening of #6 Stem Holder of Tray Base.

Figure 4:
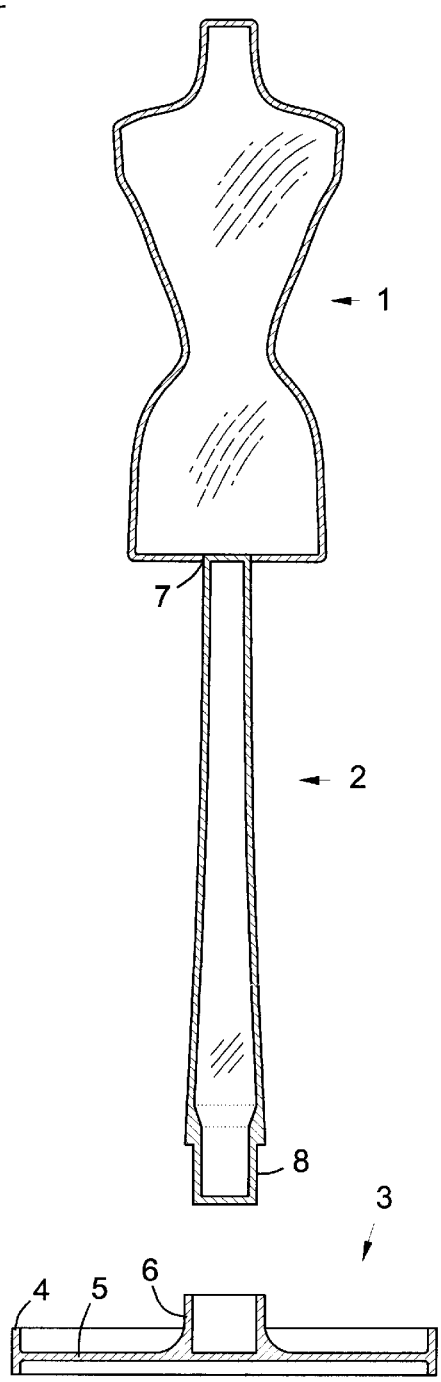
FIG. 4 Shows a View of FIG. 3 with the Tray Base REleased from the Stem.

FIG. 4 shows a View of FIG. 3 with #3 Tray Base released from #2 STem.

Figure 5:
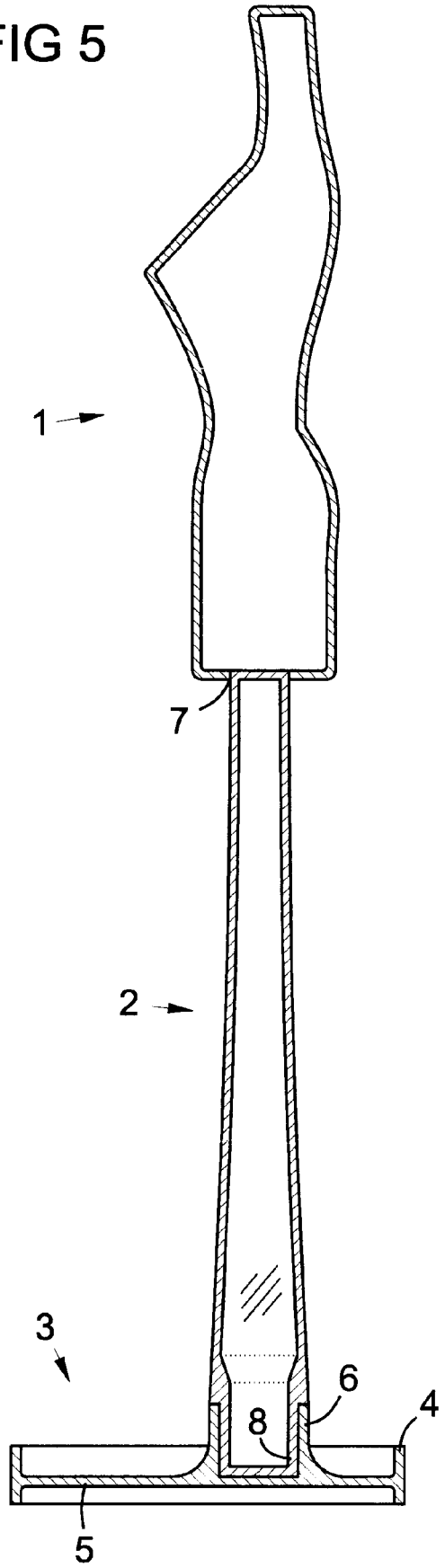
FIG. 5 Shows a Side Sectional View of the Mannequin

FIG. 5 Shows a Side Sectional View of the Mannequin with the addition of #1A Front Part of Torso and #1B Back Part of Torso which are permanently joined together. Another addition is #2A Front Part of Stem and #2B Back Part of Stem which are permanently joined together.

OPERATION OF INVENTION

FIG. 1 shows #1 Torso suitable for holding, shaping, supporting and displaying clothing such as dresses, gowns, jackets, blouses, sweaters and skirts. The mannedquin #1 Torso can be dressed by garments being placed, in a normal manner, on #1 Torso from the top over the neck and shoulders, or if too small to fit, they can be pulled into place from the #8 Lower End of Stem after it has been removed, as shown in FIG. 4, from #6 Stem Holder contained in #3 Tray Base. #2 Stem is then placed back in #6 Stem Holder of Tray Base. Thus #1 Torso and the items or articles of clothing are supported. A hat can be placed on the top of the elongate neck of #1 Torso for display.

The accessories to an ensemble, such as shoes, handbags, gloves and jewelry are placed, arranged, held contained and displayed in the #3 Tray Base on the flat #5 Horizontal Plate of Tray Base. Accessories are contained by #4 Rim on the Tray Base.

Handbags can lean against #6 Stem Holder of Tray Base and #2 Stem for upright support giving better visibility of these accessories. Long accessories such as long gloves are accommodated by being placed behind #6 Stem Holder of Tray Base leaving the front area of #5 Horizontal Plate of Tray Base open for displaying smaller items.

CONCLUSION, RAMIFICATIONS & SCOPE

Thus the reader will see that the mannequin including a properly located tray base to hold the mannequin upright; as well as; hold, contain and display accessories along with the clothing from an ensemble as they were originally produced, packaged and sold is a useful and unique product.

This invention can be made in different sizes to accommodate various sizes of doll clothes. Torso, Stem and Tray Base can be made in various shapes.

Ideally the preferred embodiment is to make the mannequin from molded parts thru vacuum forming, injection molding or blow molding. The favored form is from 5 styrene plastic parts as shown in FIG. 5, as follows: #1A Front Part of Torso which is glued or snapped on to #1B Back Part of Torso, #2A Front Part of Stem which is glued or snapped on to 2B Back Part of Stem, and #3 Tray Base.

This invention can be made of many materials including plastic, rubber, wood, metal and combinations of the foregoing, to name of few.

Although the description above contains many specificities, these should not be construed as limiting the scope of the invention but as merely providing illustrations of some of the presently preferred embodiments of this invention. For example the mannequin Torso can be made in the shape of a female, male or child. The Tray Base can be of different shapes.

Thus the scope of the invention should be determined by the claims and their legal equivalents, rather than by the examples given.

What is claimed is:

1. A doll fashion ensemble display mannequin comprising: a neck attached to a human torso display model that is connected to and supported by a vertical stem that is held upright by insertion into a flat tray base having a upturned rim around the upper outer edge.

2. A doll fashion ensemble display mannequin defined in claim 1 wherein the flat tray base includes a stem holder comprising an upturned rimmed opening that fits around and holds and supports the lower end of the stem that is connected to the torso.

* * * * *